United States Patent [19]

Green

[11] 4,004,356

[45] Jan. 25, 1977

[54] STUDDED SOLE AND HEEL PLATES FOR SHOES

[75] Inventor: William J. Green, Salt Lake City, Utah

[73] Assignee: James P. Watters, Bountiful, Utah

[22] Filed: Nov. 17, 1975

[21] Appl. No.: 632,221

[52] U.S. Cl. ..... 36/134

[51] Int. Cl.[2] ..... A43B 5/00

[58] Field of Search ..... 36/59 R, 67 A, 67 D, 36/67 B, 134, 127

[56] References Cited

UNITED STATES PATENTS

| | | | |
|---|---|---|---|
| 3,054,197 | 9/1962 | Morgan et al. | 36/67 D |
| 3,522,669 | 8/1970 | Simons | 36/67 A |
| 3,638,337 | 2/1972 | Dollar | 36/67 R |
| 3,667,141 | 6/1972 | White | 36/67 B |

*Primary Examiner*—Patrick D. Lawson
*Attorney, Agent, or Firm*—Warren F. B. Lindsley

[57] ABSTRACT

A set of specially studded sole and heel plates which may readily be cemented to the existing soles and heels of an ordinary pair of shoes to convert the shoes for wear in golfing and other sports requiring good traction under conditions commonly encountered on the golf course or in connection with track sports.

2 Claims, 8 Drawing Figures

STUDDED SOLE AND HEEL PLATES FOR SHOES

BACKGROUND OF THE INVENTION

Special shoes with studded soles and heels are essential to the successful pursuit and to some extent also to the safe pursuit of a number of sports including golf as a notable example.

Such specially studded shoes are available in sporting goods stores and pro shops where they are sold expressly for use in playing golf.

By providing better footing and improved traction for standing and walking, improved control is afforded during a power swing, fatigue is reduced during walking, and the likelihood of unexpected slipping and falling with resulting physical harm is materially reduced. As an important additional benefit, it has been recognized by greenskeepers and those responsible for the good condition of the course that the penetration of the sod by such studded soles and heels tends to aerate the soil and thereby improves the health and vigor of the grass.

However, the acquisition of a special pair of shoes for golfing adds another expensive item to the cost of outfitting for a sport which is already prohibitive on the basis of cost for a large segment of the population. Any new innovation which offers a prospect for reducing the cost of such special equipment will thus constitute a service to society by contributing to an extension of the opportunity for more people to engage in the sport.

Accordingly, the present invention provides a practical and inexpensive set of studded sole and heel plates which may be utilized to convert an ordinary pair of shoes for use in playing golf or in the pursuit of track sports.

It is therefore one object of this invention to provide a means for converting an ordinary pair of shoes into specially studded shoes for use in playing golf.

Another object of this invention is to provide a means for renovating and returning to service in a new capacity a pair of shoes no longer useful for their originally intended service by virtue of wear or surface damage.

A further object of this invention is to provide an inexpensive set of studded sole and heel plates which may easily be attached to the existing soles and heels of an ordinary pair of shoes by simply gluing or cementing the sole and heel plates in place.

A still further object of this invention is to provide a variation in which the individual studs are cemented to the existing soles and heels, such variation being particularly appropriate when the existing soles and heels are still sound and in good condition.

Further objects and advantages of the invention will become apparent as the following description proceeds and the features of novelty which characterize this invention will be pointed out with particularity in the claims annexed to and forming a part of this specification.

BRIEF DESCRIPTION OF THE DRAWING

The present invention may be more readily described by reference to the accompanying drawing in which.

DESCRIPTION OF THE PREFERRED EMBODIMENT

Figure 1:
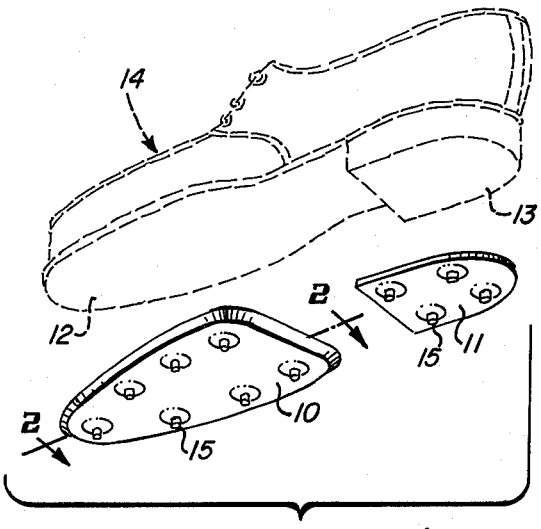
FIG. 1 is a perspective view showing the specially studded sole and heel plates of the invention in relationship to the image of a shoe to which they are intended to be attached.
Figure 3:
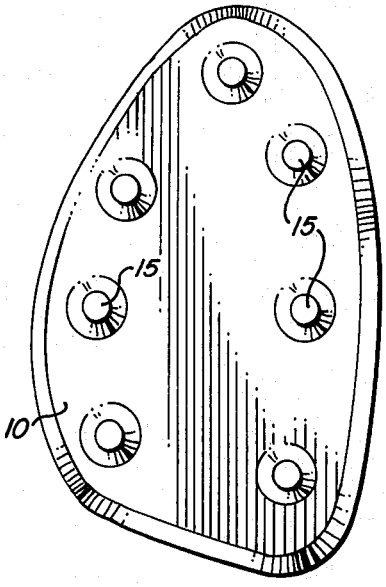
FIG. 3 is a bottom view of the sole plate of FIGS. 1 and 2.

Referring more particularly to the drawing by characters of reference, FIGS. 1–8 disclose a specially studded sole plate 10 and a mating specially studded heel plate 11 which are intended to be cemented in place on the surface of the sole 12 and heel 13 of an ordinary shoe 14 which may already have seen service in a capacity other than as a golf or track shoe.

The sole plate 10, as shown in FIGS. 1, 2, 3 and 6, comprises a thin flat plate of rubber or similarly flexible synthetic material in the shape of the well known half sole into which are molded a number of spikes or studs 15 which protrude from the bottom surface of the plate 10 in the fashion of the studs provided in commercially available golf shoes.

Figure 7:
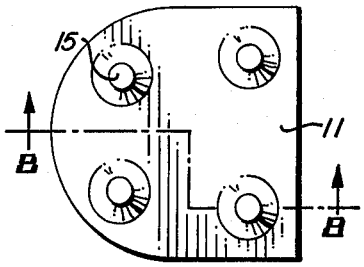
FIG. 7 is a cross-sectional view of the studded heel plate of FIGS. 1 and 7 as seen along line 8—8 of FIG. 7.
Figure 8:
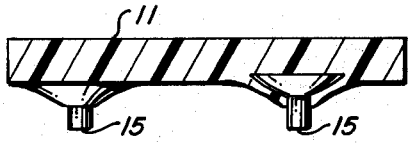

Similarly, the heel plate 11, as shown in FIGS. 1, 7 and 8, comprises a thin flat plate of the same material and thickness but in the shape of the bottom surface of the heel 13, again with a number of spikes or studs 15 molded into the plate 11 and protruding downwardly therefrom.

Figure 2:
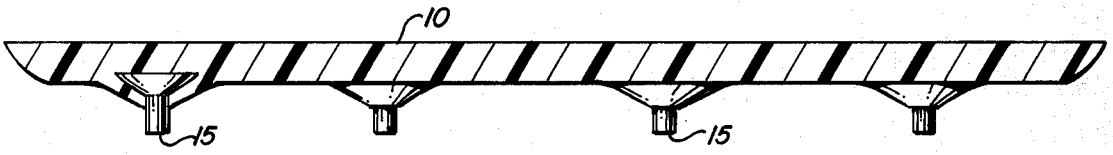
FIG. 2 is a cross-sectional view of the studded sole plate as seen along line 2—2 of FIG. 1.
Figure 4:
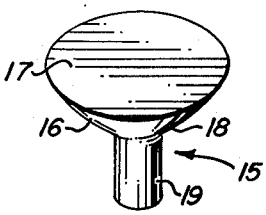
FIG. 4 is a perspective view of the stud which is molded in place in the studded sole and heel plates of FIGS. 1–3.
Figure 5:
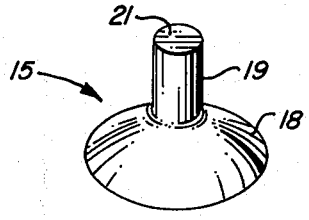
FIG. 5 is a perspective view of the stud of FIG. 4 as seen from the opposite side.
Figure 6:
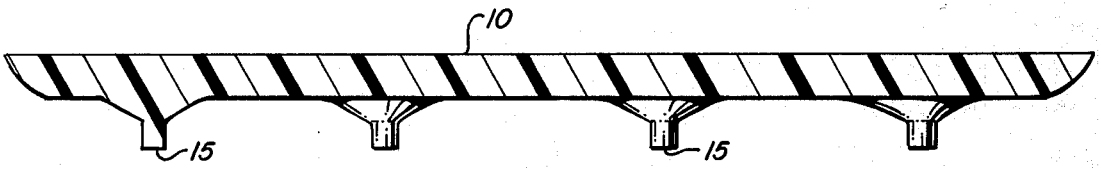
FIG. 6 is a bottom view of the studded heel plate of FIG. 1.

The stud 15, as shown most clearly in FIGS. 2, 4, 5 and 8, is in the form of a rivet having a head 16 contoured similarly to the head of a wood screw with a circular flat top surface 17 and a conical under side 18 which tapers down to the smaller diameter of the protruding cylindrical tip 19. The cylindrical tip 19 is terminated at the end opposite the head 16 in a perpendicular flat surface 21. As shown in FIGS. 2 and 8, a major portion of the cylindrical tip 19 protrudes from the plate 10 or 11 while the entire head 16 and the attached end of the cylindrical tip 19 is embedded in the rubber or synthetic material of the plate.

Such construction of the sole plate 10 or of the heel plate 11 is readily amenable to mass production techniques in which the studs are molded in place as the rubber or other material is cast or formed around them and the cost of producing the plates will accordingly be very low.

Furthermore, the studs may be produced on a screw machine at a cost which is almost insignificant in terms of the value of the product in which they are being incorporated.

Alternatively the studs 15 may be cast as an integral part of the sole plate 10 or of the heel plate 11 in the same material, and while in this variation, the studs 15 may not be effective to the same degree in penetrating the turf or soil under the most adverse conditions, i.e. where the ground is hard and dry, the cost of producing the variation may be materially reduced. In addition, if the studs are molded integrally of rubber or synthetic material, they will not damage indoor surfaces such as wood floors, plastic tile and carpeting and more freedom is thus allotted the wearer while not on the golf course or track.

In another variation of the invention, the studs 15 may simply be cemented directly to the existing sole 12 or heel 13 of the shoe 14 in a pattern or arrangement similar to the arrangement of the studs 15 in the plates 10 and 11 of the drawing. Various super cements are now readily available commercially which will hold a hard rubber or even a metal stud securely in place on a leather, rubber or synthetic sole or heel. An even more dramatic cost advantage may thus be obtained through this variation than in the case of the embodiment first described provided the condition of the original sole or heel is adequate for continued use without the benefit of plates 10 and 11.

An extremely inexpensive and yet practical and effective means is thus provided for converting an existing pair of shoes for new use as studded golf or track shoes in accordance with the specific objects of the invention.

Although but a few embodiments of the invention have been illustrated and described, it will be apparent to those skilled in the art that various changes and modifications may be made therein without departing from the spirit of the invention or from the scope of the appended claims.

What is claimed is:

1. A plate for securing to the ground engaging surface of a sole or heel of a shoe comprising:

a thin flexible plastic molded plate having a shape similar to only the ground engaging portion of the sole or heel of a shoe, a plurality of metallic stud means molded into said plate at spaced positions on its ground engaging surface thereof, each of said stud means comprising a dome shaped member protruding from the ground engaging surface of said plate a given distance and each having a like plane extending laterally of the longitudinal axis of the dome flush with the ground engaging surface of the plate, and a plurality of studs one extending out of each of the dome shaped members along their longitudinal axis in a common direction for engaging the ground on which the shoe is used, said stud means being formed integral with said dome shaped member and said plate.

2. The plate set forth in claim 1 wherein:

said stud means, dome shaped member, and sole plate are formed of similar resilient plastic material.

* * * * *